US008061480B2

(12) United States Patent
Grilliot et al.

(10) Patent No.: US 8,061,480 B2
(45) Date of Patent: Nov. 22, 2011

(54) DRAG HARNESS IMPROVEMENTS

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 11/135,082

(22) Filed: May 23, 2005

(65) Prior Publication Data

US 2005/0211188 A1 Sep. 29, 2005

Related U.S. Application Data

(63) Continuation-in-part of application No. 10/772,560, filed on Feb. 5, 2004.

(51) Int. Cl.
*A62B 35/00* (2006.01)

(52) U.S. Cl. ..... 182/3; 119/770

(58) Field of Classification Search ..... 182/3–6; 2/69; 119/770

See application file for complete search history.

(56) References Cited

U.S. PATENT DOCUMENTS

| | | | | |
|---|---|---|---|---|
| 602,861 | A * | 4/1898 | Lyon | 119/770 |
| 2,568,304 | A * | 9/1951 | Schoenbrun | 119/770 |
| 2,592,771 | A * | 4/1952 | Wampler | 224/184 |
| 2,931,629 | A * | 4/1960 | Keller | 254/409 |
| 2,956,541 | A * | 10/1960 | Rall | 434/254 |
| 4,197,816 | A * | 4/1980 | Lusch | 182/3 |
| 4,341,285 | A * | 7/1982 | Krickovich | 182/6 |
| 4,396,091 | A * | 8/1983 | Anderson | 182/3 |
| 4,494,247 | A * | 1/1985 | Kelly | 2/24 |
| 4,682,671 | A | 7/1987 | Hengstenberger et al. | |
| 4,854,418 | A | 8/1989 | Hengstenberger et al. | |
| 4,872,457 | A * | 10/1989 | Thompson | 606/121 |
| 5,253,657 | A * | 10/1993 | Butterfield | 128/845 |
| 5,785,146 | A * | 7/1998 | Palmer | 182/3 |
| 5,916,070 | A * | 6/1999 | Donohue | 482/74 |
| 6,040,251 | A * | 3/2000 | Caldwell | 442/123 |
| 6,052,824 | A * | 4/2000 | May | 2/16 |
| 6,205,584 | B1 | 3/2001 | Yocco | |
| 6,244,379 | B1 * | 6/2001 | Larson | 182/6 |
| 6,397,784 | B1 * | 6/2002 | Morgan-Albertson et al. | 119/792 |
| 2004/0124224 | A1 * | 7/2004 | Arnold et al. | 224/637 |
| 2004/0128734 | A1 * | 7/2004 | Jordan | 2/69 |
| 2004/0140152 | A1 * | 7/2004 | Richardson | 182/3 |
| 2004/0182644 | A1 * | 9/2004 | Kotarski | 182/3 |

FOREIGN PATENT DOCUMENTS

FR 2655637 A1 * 6/1991

* cited by examiner

*Primary Examiner* — Alvin Chin Shue

(74) *Attorney, Agent, or Firm* — Wood, Phillips, Katz, Clark & Mortimer

(57) ABSTRACT

A drag harness comprises two arm loops, each of which has a fixed length and is adapted to receive a separate arm of a wearer, and a gripping loop having a fixed length, joined to the arm loops. Rather than one gripping loop, a pair of gripping loops, each having a fixed length, can be advantageously used. The arm loops are made from a non-abrading material, which may be rope, such as cotton rope or polyester rope. Alternatively, the non-abrading material may be a material, such as strapping, webbing, or rope, which has a surface finish providing the material with a non-abrading characteristic.

5 Claims, 1 Drawing Sheet

14
RESCUER
56
18
18
10
20
20
12
WEARER
54
16
12
ARM
50
ARM
52

34
34

36
40
36
40
30
38
38
32
32

DRAG HARNESS IMPROVEMENTS

CROSS-REFERENCE TO RELATED APPLICATION

This application is a continuation-in-part of U.S. patent application Ser. No. 10/772,560, which was filed on Feb. 5, 2004, and the disclosure of which is incorporated herein by reference.

TECHNICAL FIELD OF THE INVENTION

This invention pertains to a drag harness of a type used by a rescuer, such as a firefighter, to drag a wearer lying in a supine position, from a perilous situation.

BACKGROUND OF THE INVENTION

As exemplified in U.S. Pat. Nos. 4,682,671, 4,854,418, and 6,205,584 B1, and in U.S. patent application Ser. No. 10/772,560, supra, and as known heretofore, drag harnesses of the type noted above have arm loops made from strapping or webbing, which tends excessively to abrade adjacent cloth, such as cloth linings of protective coats worn over such harnesses.

As exemplified therein, drag harnesses of the type noted above have gripping means comprising single loops, which can be very difficult for a rescuer to grasp with two hands or with two arms or for two rescuers to grasp. If the wearer is heavy or is laden with heavy gear, it may be quite difficult for a rescuer grasping such a loop with one hand or with one arm to drag the wearer.

SUMMARY OF THE INVENTION

According to a first aspect of this invention, this invention provides in a drag harness comprising two arm loops, each of which is adapted to receive a separate arm of a wearer, and gripping means joined to the arm loops, whereby a rescuer grasping the gripping means can drag the wearer, via the drag harness, if the wearer is lying in a supine position, an improvement wherein the arm loops are made from a non-abrading material. The non-abrading material may be a filamentary material, such as nylon rope or polyester rope, or may be cotton rope or other similarly soft rope. The non-abrading material may be or may be a material, such as strapping, webbing, or rope, which has a surface finish providing the material with a non-abrading characteristic. Preferably, the gripping means is made from strapping or webbing and comprises a single gripping loop or a pair of gripping loops. Preferably, moreover, each gripping loop of the gripping means has a fixed length.

According to a second aspect of this invention, this invention provides in a drag harness comprising two arm loops, each of which is adapted to receive a separate arm of a wearer, and gripping means joined to the arm loops, whereby a rescuer grasping the gripping means can drag the wearer, via the drag harness, if the wearer is lying in a supine position, an improvement wherein the gripping means comprises plural gripping loops, preferably a pair of gripping loops but conceivably three or more gripping loops. Preferably, whether made from rope, from strapping or webbing, or from other material, each of the arm loops has a fixed length. Preferably, each of the gripping loops of the gripping means has a fixed length.

The first and second aspects of this invention can be advantageously combined in a drag harness.

DETAILED DESCRIPTION OF THE ILLUSTRATED EMBODIMENTS

Figure 1:
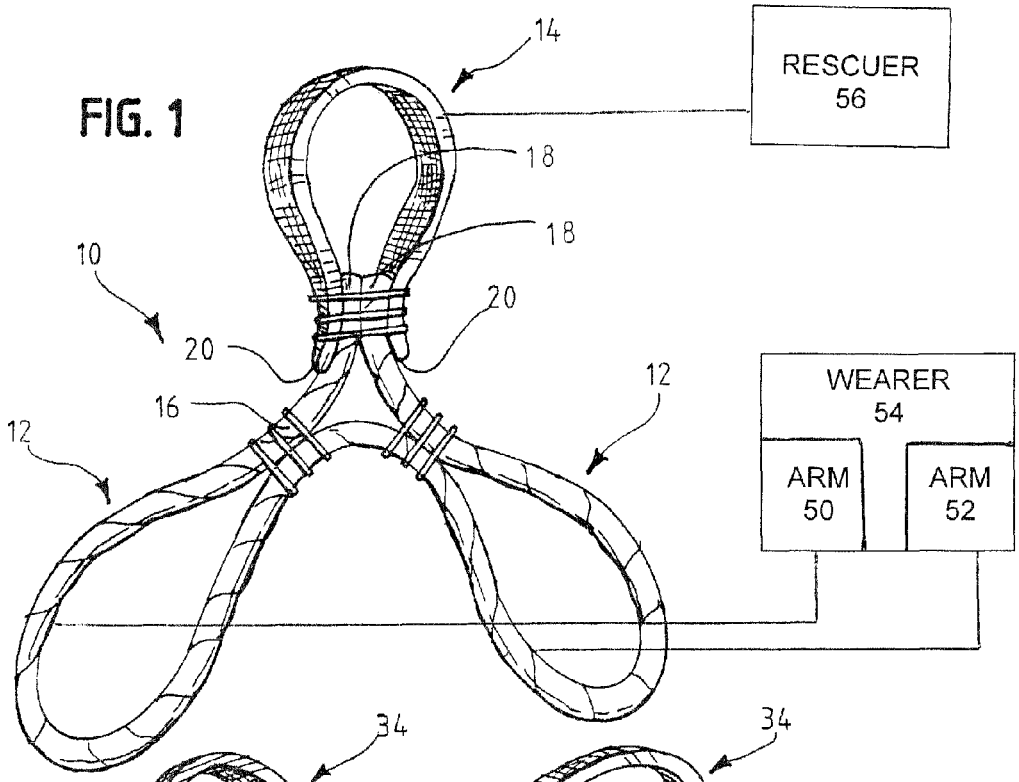
FIG. 1 is a pictorial view of a drag harness embodying the first aspect of this invention.

As illustrated in FIG. 1, a drag harness 10 embodies the first aspect of this invention. Except as illustrated and described herein, the drag harness is similar to the drag harness illustrated and described in U.S. patent application Ser. No. 10/772,560, supra, and is utilized similarly.

The drag harness 10 comprising two arm loops 12, each of which has a fixed length and is adapted to receive a separate arm of a wearer, and gripping means joined to the arm loops 12, whereby a rescuer grasping the gripping means can drag the wearer, via the drag harness 10, if the wearer is lying in a supine position. The gripping means comprises a single gripping loop 14, which is made from strapping or webbing and which has a fixed length.

As contemplated by this invention, the arm loops 12 are made from a non-abrading material, which is illustrated as rope. The non-abrading material may be filamentary rope, such as filamentary Kevlar™ rope or filamentary Nomex™ rope, or may be cotton rope or other similarly soft rope. The non-abrading material may be material, such as strapping, webbing, or rope, which has a non-abrading surface or which has a surface finish, such as a Teflon™ polytetrafluoroethylene finish or another suitable finish, which provides the material with a non-abrading surface. Herein, non-abrading means having a minimal tendency to abrade adjacent cloth, such as a cloth liner of a protective coat worn over the arm loops 12 of the drag harness 10.

As illustrated, the arm loops 12 are provided by the non-abrading material in a single continuous length, which is deployed across itself at two crossings 16 and which is attached to itself at the crossings 16, by stitching and lashing, thereby defining separate connections, so as to define the arm loops 12 and so as to provide that each arm loop 12 has a fixed length. Each end 18 of the single length of the non-abrading material is attached, by stitching and lashing, to one end 20 of the single loop 14 at a third connection. The loop 14 is defined preferably by a continuous length of webbing/strapping that is folded to the loop shape and joined directly to the single length of material defining the arm loops 12. The lengths of material making up the loop 14 and arm loops 12 are shown with a different construction.

Figure 2:
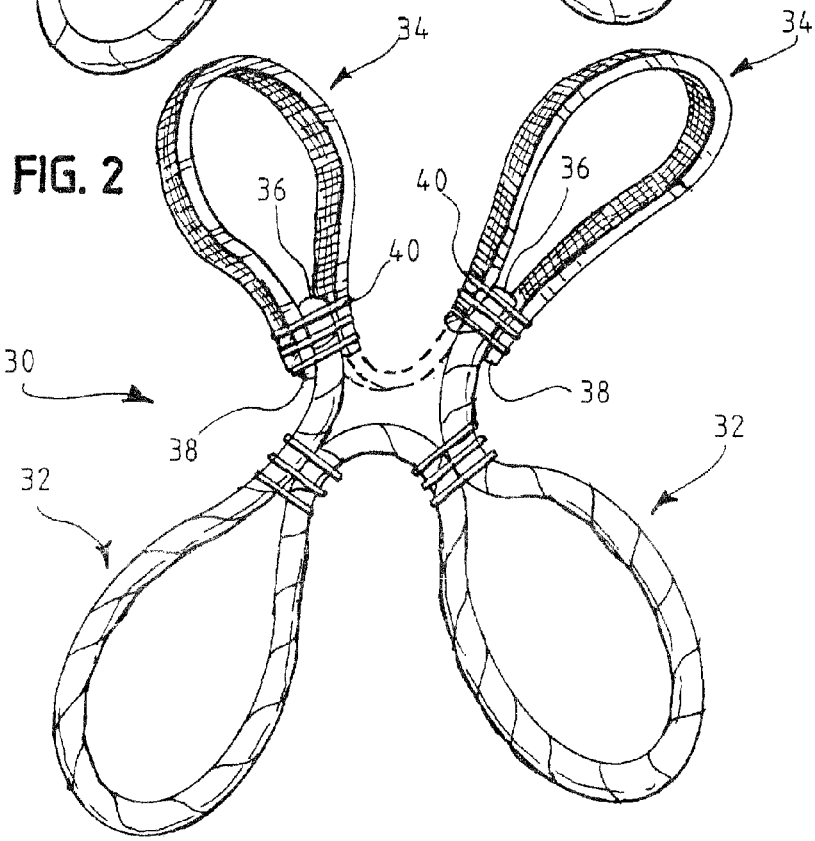
FIG. 2 is a pictorial view of a drag harness embodying the second aspect of this invention, as well as the first aspect of this invention.

As illustrated in FIG. 2, a drag harness 30 embodies the second aspect of this invention, as well as the first aspect of this invention. Except as illustrated and described herein, the drag harness is similar to the drag harness 10 and to the drag harness illustrated and described in U.S. patent application Ser. No. 10/772,560, supra, and is utilized similarly.

The drag harness 30 comprises two arm loops 32, which are similar to the arm loops 12 of the drag harness 10 and which, as illustrated, are made from a single length of soft rope, and a pair of gripping loops 34, which are made from a single length of strapping or webbing. Each end 36 of the single length of soft rope used for the arm loops 32 is attached, by stitching and lashing, to one end 38 of the single length of strapping or webbing used for the pair of gripping loops 34 and to an intermediate portion 40 of the single length of strapping or webbing used for the pair of gripping loops 34, so as to define the pair of gripping loops 34 and so as to provide for each gripping loop 34 to have a fixed length.

Thus, a rescuer can grasp a separate one of the gripping loops 34 with each hand or with each arm or two rescuers can work together, each grasping a separate one of the gripping loops 34 with one hand or with one arm, so as to facilitate dragging a heavy wearer or a wearer laden with heavy gear.

As seen in FIG. 1, first and second arms 50, 52 on a wearer 54 can be directed, one each, into the two arm loops 12 so that the gripping loop is situated to be gripped and drawn by a rescuer 56 to cause the arm loops to follow the gripping loop and thereby drag the wearer.

The invention claimed is:

1. In a drag harness comprising two arm loops, each of which is adapted to receive a separate arm of a human wearer, and gripping means joined to the arm loops, whereby a rescuer can drag the wearer, if the wearer is lying in a supine position, an improvement wherein the arm loops are made from a material, the material being at least one of a filamentary para-aramid synthetic fiber and meta-aramid synthetic fiber, one of the arm loops defined by a first connection at which the material of the arm loop is joined to itself, the other of the arm loops defined by a second connection at which the material of the other arm loop is joined to itself, the first and second connections being separate from each other, wherein the arm loops are defined by a first continuous length of the material that is joined to itself at the first and second connections to define a fixed length for each of the arm loops, wherein the gripping means is connected directly to the single continuous length of the material, wherein the gripping means comprises a second continuous length of material that is folded to define a third loop that is directly joined to the first continuous length of material, the first length of material has spaced ends and the spaced ends and third loop are joined to each other at a third connection, wherein the second length of material has spaced ends and the spaced ends of the second length of material and spaced ends of the first length of material are joined to each other at the third connection.

2. The improvement of claim 1, wherein the gripping means is made of strapping or webbing.

3. The improvement of claim 2, wherein the gripping means comprises a single gripping loop.

4. The drag harness according to claim 1 wherein the material in the second length of material has a different construction than the first length of material.

5. The combination according to claim 4 wherein the material in the first length of material is in the form of a rope and the second length of material is in the form of one of strapping or webbing.

* * * * *